US006283816B1

(12) United States Patent
Pascual

(10) Patent No.: US 6,283,816 B1
(45) Date of Patent: Sep. 4, 2001

(54) MINIATURE KITES AND METHOD FOR MAKING THEM

(76) Inventor: Ricardo Pascual, 385 Tavernier Cir., Oldsmar, FL (US) 34677

( * ) Notice: Subject to any disclaimer, the term of this patent is extended or adjusted under 35 U.S.C. 154(b) by 0 days.

(21) Appl. No.: 09/506,891

(22) Filed: Feb. 18, 2000

(51) Int. Cl.[7] ..... A63H 27/00

(52) U.S. Cl. ..... 446/34; 446/61; 446/86; 446/87; 244/153 R; 244/155 R

(58) Field of Search ..... 244/153 R; 446/34, 446/487, 488, 49, 61, 387, 388, 87, 62, 64, 65, 66, 67, 68, 30

(56) References Cited

U.S. PATENT DOCUMENTS

| | | | | |
|---|---|---|---|---|
| Re. 30,073 | * | 8/1979 | Worsham | 244/153 R |
| 2,472,137 | * | 6/1949 | Winslow | 244/153 R |
| 2,588,293 | * | 3/1952 | Rice | 244/153 R |
| 2,785,870 | * | 3/1957 | Green | 244/153 R |
| 3,697,023 | * | 10/1972 | Jackson | 244/153 R |
| 4,354,647 | * | 10/1982 | Carpenter | 244/153 R |
| 4,871,133 | * | 10/1989 | Alonso | 244/153 R |
| 4,911,383 | * | 3/1990 | Elson | 244/153 R |
| 5,000,401 | * | 3/1991 | Barone | 244/153 R |
| 5,027,539 | * | 7/1991 | Orsini | 244/155 R |
| 5,127,611 | * | 7/1992 | Payne et al. | 244/153 R |
| 5,655,944 | * | 8/1997 | Fusselman | 446/67 |

* cited by examiner

*Primary Examiner*—Jacob K. Ackun, Jr.
*Assistant Examiner*—Urszula M Cegielnik
(74) *Attorney, Agent, or Firm*—Ronald E. Smith; Smith & Hopen, P.A.

(57) ABSTRACT

A miniature kite that flies indoors or outdoors is made by cutting a small piece of tissue paper into any preselected shape, including the shape of a standard diamond-shaped kite. Toothpick-like sticks serve as the frame of the miniature kite and are adhered to a first side of the kite body to form a frame that maintains the preselected shape. Two elongate ribbons are secured to one another at their respective leading ends and are secured to the trailing end of the kite body. In a first embodiment, a string is attached to a triangular flap that is adhered to a second side of the kite body. The flap is folded at its base so that it lies in a plane perpendicular to the kite body when functioning. In a second embodiment, a unique tool is used to facilitate the kite-making process. The tool includes a pair of laterally spaced apart upstanding posts mounted on a base. The end of a kite string is looped around the posts and tied into a knot to form a loop. The knot is positioned midway between the posts and the loop is then removed from the posts by a template having the same size and shape as the miniature kite but having plural notches formed in it. When the template removes the loop from the posts, opposite ends of the loop enter into a pair of notches formed in the template to align a bottom section of the loop with a slot that is coincident with the longitudinal axis of the template. The template is then placed atop the kite body and glue is applied to the opposite ends of the bottom section of the loop. When the template is removed, the bottom section of the loop is adhered to the second side of the kite body and the upper part of the loop is engaged to the elongate kite string by the knot that was tied when the loop was made. The kite string may be tethered to a desktop fan or other source of flowing air so that indoor office workers may enjoy observing the kite as it flies. Due to its very low weight, it remains aloft in the slightest breeze.

6 Claims, 6 Drawing Sheets

MINIATURE KITES AND METHOD FOR MAKING THEM

BACKGROUND OF THE INVENTION

1. Field of the Invention

This invention relates, generally, to kites and methods for making kites. More particularly, it relates to miniature kites suitable for use both indoors and outdoors and to methods that facilitate the making of such miniature kites.

2. Description of the Prior Art

Kites and construction techniques for making them are of course well known but there are a number of problems with such construction methods when the size of the kite is reduced to approximately the size of an index card.

A very small kite has utility as a novelty item because, unlike a full-size kite, it can be flown indoors. Those who have office jobs cannot enjoy full size kites during working hours. However, a miniature kite can be tethered to a small portable fan, or other source of blowing air, and enjoyed even by office workers. A gaily-colored miniature kite with long flowing tails in flight is just as much fin to watch indoors as is a full-sized kite when flown outdoors. Accordingly, a miniature kite flying in an office has great stress-reducing qualities, and provides an aesthetically pleasing, mobile display that enlivens a sterile office or cubicle environment.

The construction of a small, very light-in-weight kite, however, is somewhat problematic. For example, it is hard to attach the kite string to the kite in the correct location, especially when there is a requirement that many of such kites be assembled quickly. A nimble-fingered worker can do the job quite well, but it is difficult to maintain the same consistent quality of work throughout the workday.

What is needed, then, is a means for facilitating miniature kite manufacturing. The needed means should produce miniature kites of consistently high quality, should make the assembler's job easy, and should lower the level of skill required to perform the assembly task. Moreover, the quantity of kites that could be manufactured per hour should be high so that the cost of each kite to the consumer could be low.

There is also a need for a miniature kite that is aerodynamically designed so that it may also be flown outdoors like a full-size kite.

However, at the time the present invention was made, it was not obvious to those of ordinary skill in the kite-making art how these needs could be fulfilled, how such miniature kite could be constructed and how the difficulties inherent in miniature kite making could be overcome.

SUMMARY OF THE INVENTION

The objects of this invention are achieved by a new, useful and nonobvious invention. The novel method for making the miniature kite of this invention includes the steps of forming from tissue paper a kite body of predetermined configuration, forming from tissue paper a flap member of predetermined configuration, making a frame that maintains the preselected configuration of the kite body by securing at least a first elongate support member to a first side of the kite body and at least a second elongate support member to the first side of the kite body, and securing an elongate tail means to a trailing end of a preselected side of said kite body.

An elongate string is first coiled about a dowel pin, and a short predetermined length of the string is then uncoiled from the dowel pin. The free end of the uncoiled length of string is then adhered to the flap member. An elongate base of the flap member is then secured to a second side of the kite body in substantial registration with the longitudinal axis of the kite body. The flap member is then folded along its base so that the main body of the flap member is positioned at a substantially right angle to the kite body, and the miniature kite is ready to fly.

In a second embodiment, a kite body of predetermined configuration is formed of tissue paper as in the first embodiment, at least a first and a second elongate support member is secured to a first side of the kite body to form a frame that maintains the preselected shape of the kite body. An elongate tail means is then secured to a trailing end of a preselected side of the kite body, all as in the first embodiment.

An elongate string is coiled about a dowel pin and a predetermined length of the string is uncoiled from the dowel pin.

A pair of upstanding posts are mounted in laterally spaced apart relation to one another. A taut loop is formed around the posts by wrapping the uncoiled length of string around the posts and a knot is tied therein to maintain the taut loop around the posts. The knot is positioned about midway between the posts.

A template having substantially the same shape and size as the kite body is provided. A closed end slot is formed in the template coincident with a longitudinal axis of the template such that first and second ends of the closed end slot are spaced apart from leading and trailing ends of the kite body, respectively, by a predetermined distance. A first notch is formed in a first preselected side of the template near a leading end thereof. The first notch extends at its deepest point to a longitudinal axis of symmetry of the template. The deepest point of the first notch is positioned between the first end of the closed end slot and a leading end of the template. A second notch is also formed in the first preselected side of the template near a trailing end thereof. The second notch extends at its deepest point to a longitudinal axis of symmetry of the template. The deepest point of the second notch is positioned between the second end of the closed end slot and a trailing end of the template.

The loop is removed from the posts by inserting the first preselected side of the template through the loop, and positioning opposite ends of the loop in the first and second notches, respectively. The loop has a top section disposed on a first side of the template and a bottom section disposed on a second side of the template. The template is positioned atop the kite body in alignment therewith so that the bottom section of the loop is disposed in overlying relation to the kite body. A top section of the loop is then pulled in a direction away from the slot formed in the template and the bottom section of the loop is secured to the kite body by applying an adhesive to the bottom section and the kite body at first and second points at opposite ends of the closed end slot. The first and second points being predetermined by the length of the closed end slot and by the registration of the template to the kite body. The template is then removed from the kite body and the kite is ready for use.

It is therefore understood that a primary object of this invention is to provide fast and efficient means for making miniature kites of consistently high quality.

A closely related object is to lower the skill level required for miniature kite assembly so that they can be economically produced.

Another important object is to make a miniature kite from very lightweight materials so that it can fly in very low air movement conditions.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
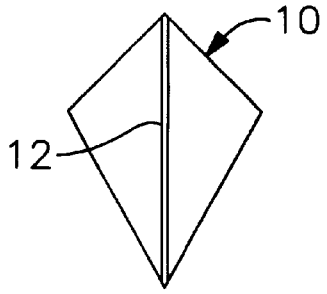
FIG. 1 is a top plan view of a kite body formed of tissue paper after a first frame member has been secured thereto.

Referring now to FIG. 1, it will there be seen that the miniature kite body of this invention is denoted as a whole by the reference numeral 10. Like standard kite bodies, it is substantially diamond-shaped, having a longitudinal extent that exceeds its transverse extent. The preferred longitudinal extent is about four and nine-sixteenths inches and the preferred transverse extent is about three and five sixteenths inches.

Figure 2:
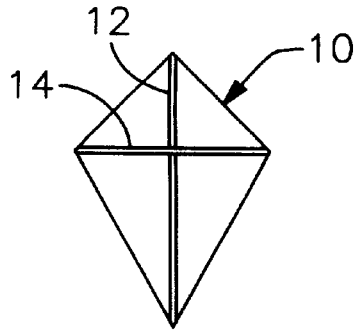
FIG. 2 depicts the kite body of FIG. 1 after a second frame member has been secured thereto.

In FIG. 1, a basswood stick 12 has been adhered to a first side of kite body 10. Although the step of adhering said basswood stick 12 to kite body 10 might be accomplished by any suitable means, the preferred technique is to prepare white glue that has been diluted, and to brush that watered-down white glue onto a first side of basswood stick 12. Undiluted glue wrinkles the paper. Stick 12 is then positioned on the kite body in alignment with the longitudinal axis thereof as indicated in FIG. 1, and the glue is allowed to cure. A second, transversely disposed basswood stick 14 is then adhered in the same manner to the kite body as depicted in FIG. 2. If either or both basswood sticks have a slight warp or curvature, then the convex side of the warp or curvature is disposed against the kite body to optimize the shape thereof for flying. Sticks 12 and 14 collectively form a frame that maintains the shape of the kite body.

Figure 3A:
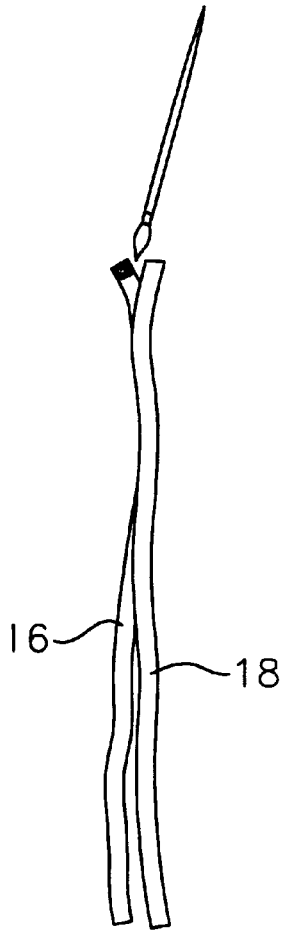
FIG. 3A depicts the first step in a kite tail-attaching method.
Figure 3B:
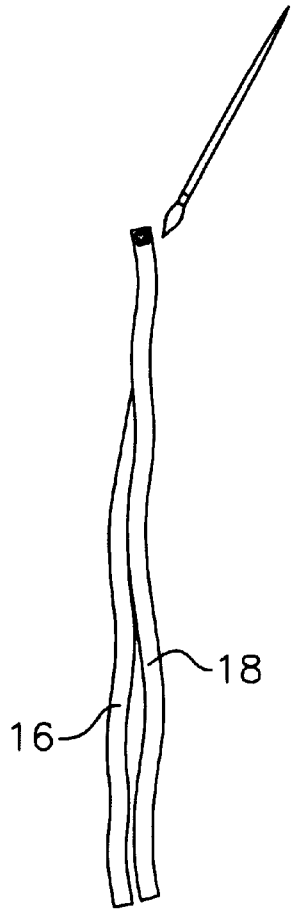
FIG. 3B depicts the second step in said tail-attaching method.
Figure 3C:
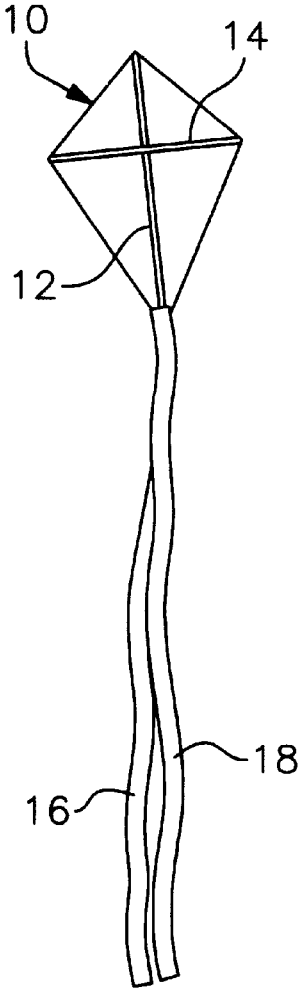
FIG. 3C depicts the third step in said tail-attaching method.

The preferred embodiment of the novel miniature kite includes two tail ribbons, although different numbers thereof are within the scope of this invention. The ribbons are preferably about nine-sixteenths of an inch in width and between twenty six to twenty eight inches in length. The ribbon attaching procedure is depicted in FIGS. 3A, 3B, and 3C. As indicated in FIG. 3A, the diluted glue is applied by a suitable brush means to a first end of one of the ribbons; the glue extends from the leading end of ribbon 16 to a point about one-half inch from said end. The leading end of ribbon 18 is then pressed thereagainst and the two ribbons are joined to one another when the glue sets. The brush is then used again to apply glue to an exterior surface of either ribbon, as indicated in FIG. 3B. This glue extends form the end of the ribbon to a point about one-quarter inch from said end. The glued end of the ribbon is then pressed against kite body 10 at its trailing end as indicated in FIG. 3C and the tail connecting procedure is finished when the glue cures. Note that the ribbons are preferably attached to kite body 10 on the same side thereof as are the basswood sticks.

In the preferred embodiment, each ribbon of the ribbon pair is of a different color for artistic purposes.

Figure 4:
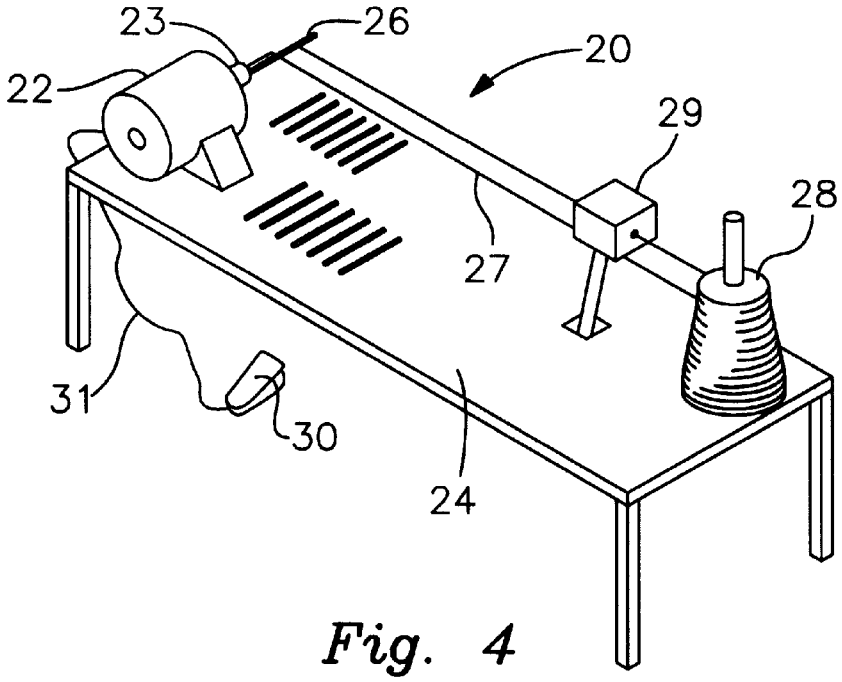
FIG. 4 is a perspective view of an apparatus for coiling a kite string about a dowel pin.

The next few steps of the method are performed to attach a predetermined length of string to a dowel pin. A preselected end of the string, which is preferably cotton thread, is first attached to the center of the dowel pin by any suitable means. About one hundred feet of the cotton thread is then wound onto the dowel pin by any suitable means. As depicted in FIG. 4, an apparatus 20 that includes a small variable speed electric motor 22 mounted on table 24 may accomplish this. A chuck means 23 holds dowel pin 26 so that rotation of the output shaft of the motor is transferred to the dowel pin. A rotatably mounted thread spindle 28 feeds thread 27 and a thread foot counter 29 counts the number of feet that has been fed to the dowel pin so that the operator can stop the procedure when the desired footage has been coiled onto the dowel pin. A foot pedal 30 is electrically connected as at 31 to motor 22 to enable hands-free control of the motor. The operator may manually oscillate the thread along dowel pin 26 as thread 27 is fed onto the dowel pin to create a coil that is about two inches in length. Since dowel pin 26 is preferably about three and one-half inches in length, this will leave about three-quarters of an inch of the dowel pin on each end thereof that is free of thread.

Figure 5A:
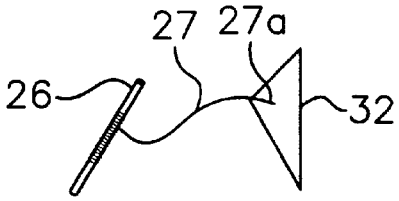
FIG. 5A depicts the step of attaching a free end of the kite string to a flap.
Figure 5B:
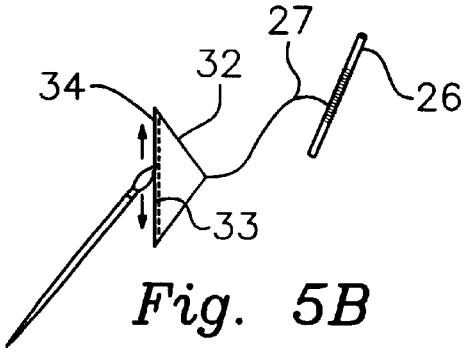
FIG. 5B depicts the step of applying an adhesive to said flap.

The next step is to adhere a free end of the cotton thread to a preferably triangular-shaped flap 32 as depicted in FIG. 5A. Diluted white glue is applied by any suitable means to the free end 27*a* of thread 27 for an extent of about one-half of an inch, and said glue-covered free end is then placed into overlying relation to flap 32 as depicted. When the glue dries, flap 32 is inverted as depicted in FIG. 5B and a narrow strip of adhesive 33 is applied to the long edge 34 of flap 32; the width of the adhesive strip is about one-eighth of an inch.

Figure 5C:
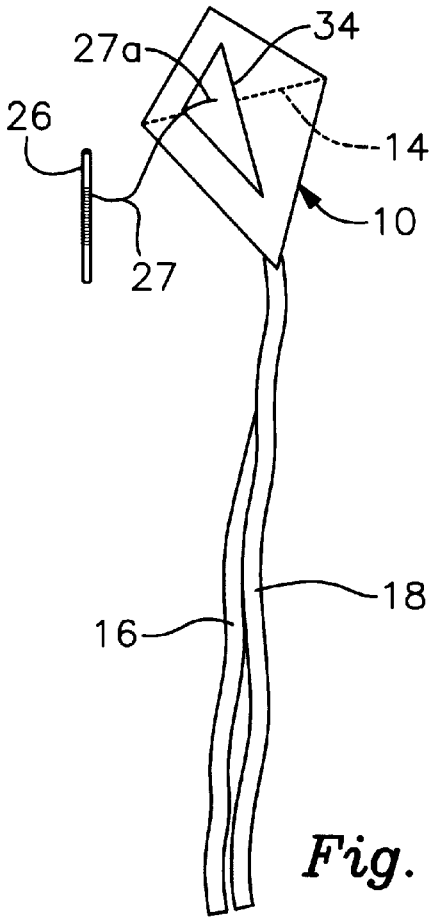
FIG. 5C depicts the attachment of the flap to the kite body.

Kite body 10 is then inverted so that basswood sticks 12, 14 are down, and the glued edge of triangular flap 32 is pressed against the stick-free side of kite body 10, substantially in alignment with the longitudinal axis thereof, as depicted in FIG. 5C. More particularly, the long edge 34 of flap 32 is positioned slightly to the right of longitudinal stick 12 (which is on the opposite side of kite body 10), so that the glue strip will substantially straddle the longitudinal axis of said kite body. The top of the flap is positioned about three-quarters of an inch from the leading end of the kite body; this positions end 27*a* of cotton thread 27 substantially coincident with transverse stick 14.

Figure 6:
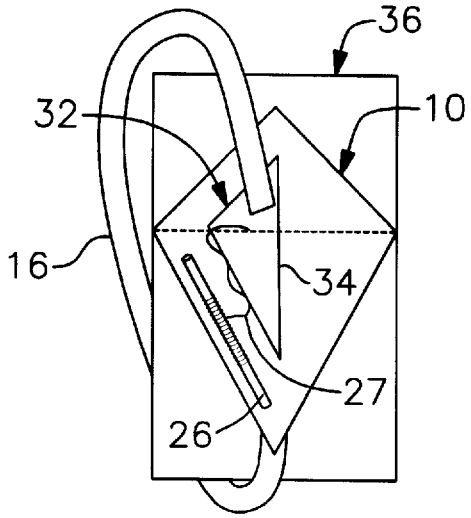
FIG. 6 depicts how the kite is prepared for shipment.

Since the miniature kite is made of fragile tissue paper, it is prepared for shipping by placing it atop a relatively stiff three by five card, preferably made of pressboard, denoted 36 in FIG. 6. Ribbons 16, 18, that form the kite tail are coiled around the index card as shown and dowel pin 26 is also positioned as shown to prevent damage to the kite.

It is noted that flap 32, while being very light-in-weight, nonetheless adds weight to the novel kite. Accordingly, a second embodiment of the novel miniature kite eliminates flap 32 and results in a lighter kite that stays aloft in very low wind conditions. The kite body of the second embodiment is made in the same manner as the kite body of the first embodiment, i.e., a two or more basswood sticks are glued to a first side thereof in the manner disclosed in connection with the first embodiment. Moreover, a suitable length of cotton thread is coiled about a dowel pin in any suitable manner, as in the first embodiment.

Figure 7:
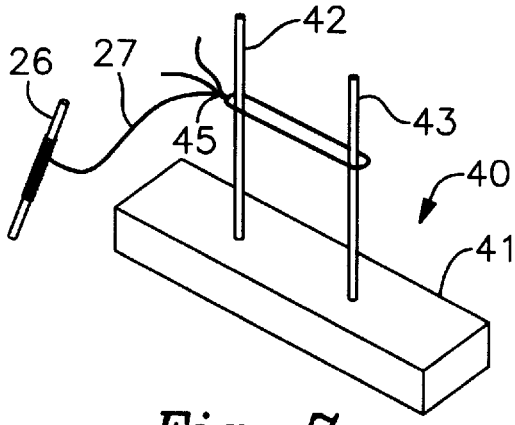
FIG. 7 is a perspective view of a tool used in making a second embodiment.

A novel tool for making the second embodiment of the novel miniature kite is denoted by the reference number 40 as a whole in FIG. 7. Tool 40 includes a base 41 of predetermined configuration, such as rectangular as depicted, and a pair of upstanding, parallel posts 42, 43, mounted to base 41 in laterally spaced relation to one another.

Figure 8:
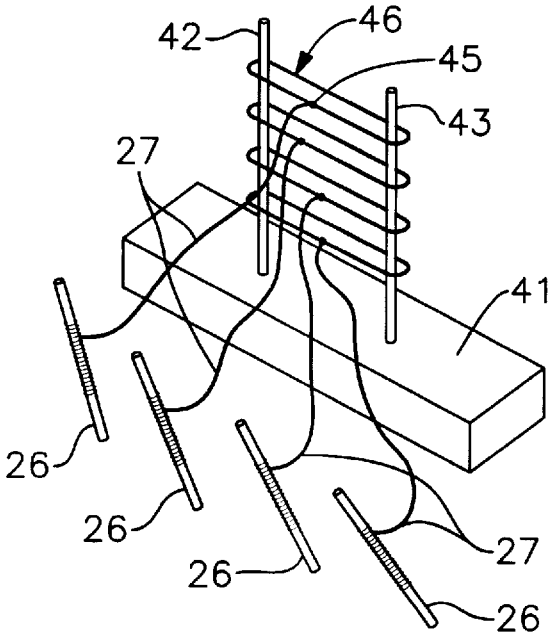
FIG. 8 is a view like that of FIG. 7, depicting multiple loops formed on said tool.

A predetermined length, such as nine inches, for example, of cotton thread 27 is unwound from dowel pin 26. The free end of the string is wrapped tautly about posts 42, 43 and a knot 45 is tied therein, using one of the posts as a support for the knot-tying procedure as indicated in FIG. 7. A dab of glue may be added to the knot. Since this glue does not contact the tissue paper, it need not be diluted. Any excess string is cut off with a pair of scissors or other suitable cutting implement. The string that wraps tautly around the posts is then rotated thereabout until knot 45 is positioned about half way between posts 43, 44 as indicated in FIG. 8. Knot 45 should be facing dowel pin 26.

As also indicated in FIG. 8, the above procedure may be repeated multiple times if desired so that a plurality of taut loops, collectively denoted 46, are held by posts 43, 44. The preparation of multiple loops 46 facilitates the making of multiple miniature kites in a short amount of time as will become clear as this description proceeds.

Figure 9:
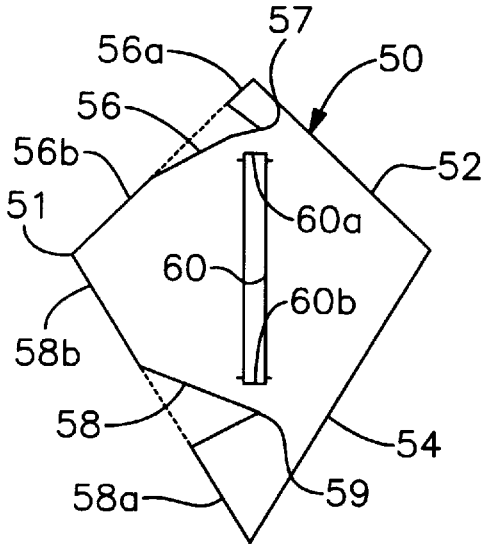
FIG. 9 is a top plan view of the novel template used in making the second embodiment of the kite.

FIG. 9 depicts the novel template 50 that is used in making the novel miniature kites. Template 50 is made of a durable material such as a relatively thick stock paper or the like. As indicated by the phantom lines appearing in FIG. 9, the initial size and shape of template 50 matches the size and shape of the finished kite if the kite is of the traditional diamond shape. The shape of template 50 may be changed to match other kite body shapes in those embodiments where the kite body is triangular, rectangular, or some other predetermined shape.

Template 50 has two sides 52, 54, on a first side of the longitudinal axis of the template that matches two of the sides of the finished kite. It should also be observed that template 50 includes sides 56*a*, 56*b*, 58*a*, and 58*b* on the opposite side of said longitudinal axis that match corresponding sections of said finished kite. A first triangular cutout 56 is formed near the leading end of template 50 and a second triangular cutout 58 is formed in said template near the trailing end thereof. These cutouts provide leading and trailing notches 57, 59 respectively at their deepest points.

Template 50 further includes a narrow, elongate slot 60 formed therein in coincidence with the longitudinal axis of symmetry of said template. The opposite ends 60*a*, 60*b* of slot 60 are closed and are respectively disposed in close proximity to notches 57, 59.

The letters "A," "B," "C," "D," and "E," or similar indicia, are pre-printed on template 50. The utility of these indicia will be explained as this description continues.

Figure 10:
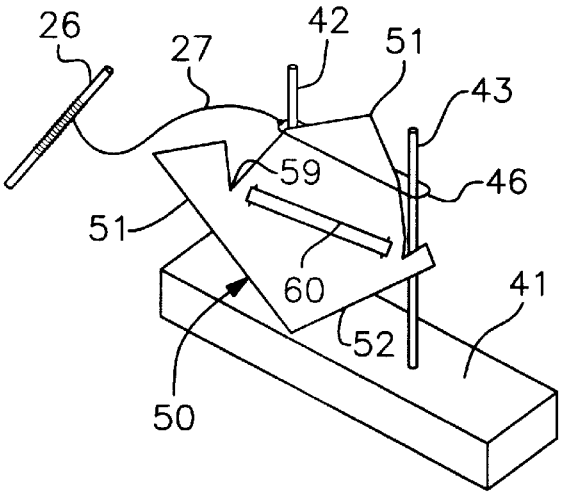
FIG. 10 is a perspective view depicting how the template is used to grab a loop from the tool.
Figure 11:
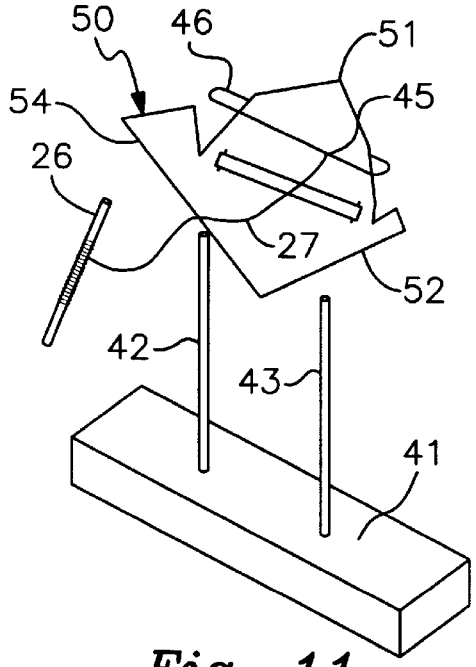
FIG. 11 is a perspective view depicting how the template is used to remove a loop from the tool.
Figure 12:
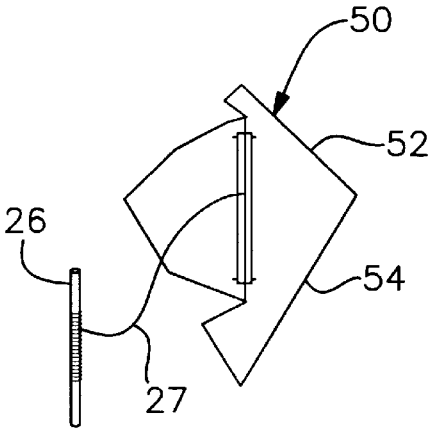
FIG. 12 depicts the template after the loop is fully positioned thereon.

To use template 50, point 51 thereof is inserted through a loop 46 as depicted in FIG. 10. If multiple loops have been tied, the template is passed through the uppermost loop first. As indicated in FIG. 11, the loop is displaced upwardly and removed from posts 42, 43. As indicated in FIG. 12, loop 46 is manipulated until the opposite ends thereof are respectively seated in notches 57, 59 which are marked "A" and "B" as mentioned above. Significantly, this aligns the loop with the longitudinal axis of template 50, placing said loop substantially equidistantly from the elongate sides of slot 60. Next, the loop is rotated manually if needed until knot 45 is positioned at position "C" on said template 50.

Figure 13:
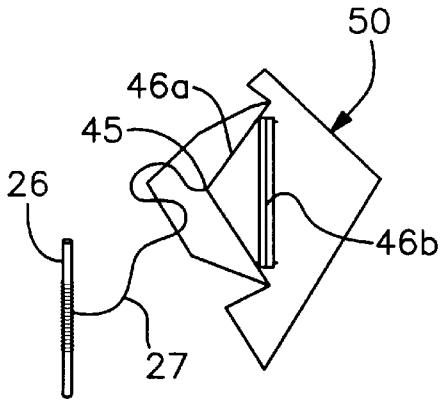
FIG. 13 depicts the step where the upper part of the loop is pulled off to one side of the template.

As indicated in FIG. 13, the next step of the novel method is to loop cotton thread 27 extending from dowel pin 26 through slots D and E. This pulls the upper half 46*a* of loop 46 away from the stationary bottom half 46*b* thereof so that two straight sections of upper half 46*a*, on opposite side of knot 45, form a triangle with said stationary bottom half 46*b* as depicted.

Figure 14A:
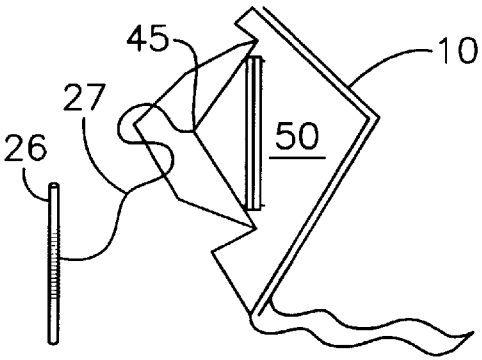
FIG. 14A depicts how the string is secured after the loop is pulled to the side.

As indicated in FIG. 14A, the next step of the manufacturing process is to position template 50 atop kite body 10 so that the respective straight edges thereof match as depicted. In this illustrative example, where notches 57, 59 have been formed in the left side of template 50, the right edges of the template are aligned with the right edges of kite body 10. Of course, where the notches are formed on the opposite side of the template, the left side thereof would be aligned with the left side of the kite body. In FIG. 14A, template 50 is depicted slightly out of registration with kite body 10, just to suggest the overlying relationship of said template 50 to said kite body 10. When template 50 is properly aligned atop kite body 10, the edges of said kite body are not visible as indicated in FIG. 14A.

It has been determined that the step of positioning template 50 atop kite body 10 in the manner as just described and depicted in FIG. 14A is best performed when kite body 10 is supported on a table top, not shown, at the edge thereof so that miniature kite tails 16, 18 may dangle downwardly over the edge of the table top so that they do not get in the way of the manufacturing procedure.

When template 50 is correctly aligned with kite body 10, the stationary lower section 46*b* of loop 46 will be in alignment with basswood stick 12 and hence with the longitudinal axis of symmetry of kite body 10. Again, however, it should be noted that sticks 12 and 14 are on the underside of kite body 10, i.e., on the side thereof opposite to string 27.

Figure 14B:
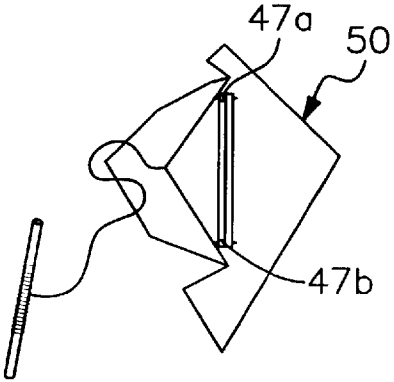
FIG. 14B depicts the application of adhesive that secures the bottom half of the loop to the kite body.

A small dab of adhesive 47*a*, 47*b* is then applied at points A and B to the opposite ends of bottom loop 46*b*, as indicated in FIG. 14B, to adhere said opposite ends to kite body 10. The adhesive, preferably undiluted white glue, is placed on the string and on the kite body so that said string is adhered to said kite body when the glue cures after a few minutes. The small dab of adhesive may be applied by dipping a toothpick or similar implement into ajar of adhesive so that a small quantity of adhesive is deposited onto the free end of said small implement. It is then simply transferred to the kite body and string at said points A and B. Alternatively, an adhesive-dispensing syringe or similar tool could be used to deposit the glue in the proper spots. Since this adhesive is applied at distinct points (points A and B as aforesaid), paper wrinkling is not a concern and fullstrength glue may be used.

Figure 14C:
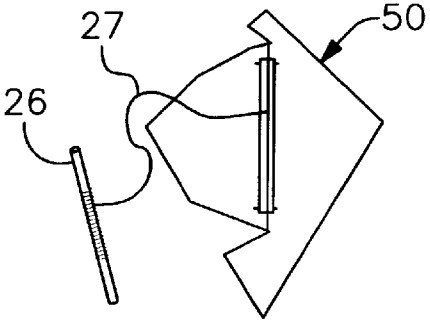
FIG. 14C depicts the step of releasing the string so that the top half of the loop returns to its position of repose.
Figure 14D:
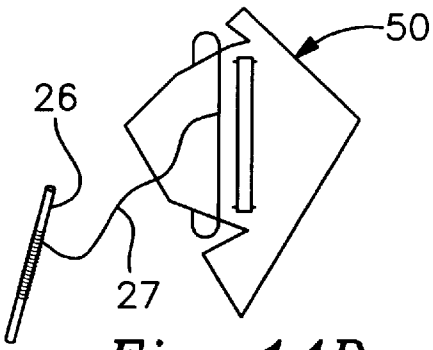
FIG. 14D depicts the step of removing the template from the loop.
Figure 14E:
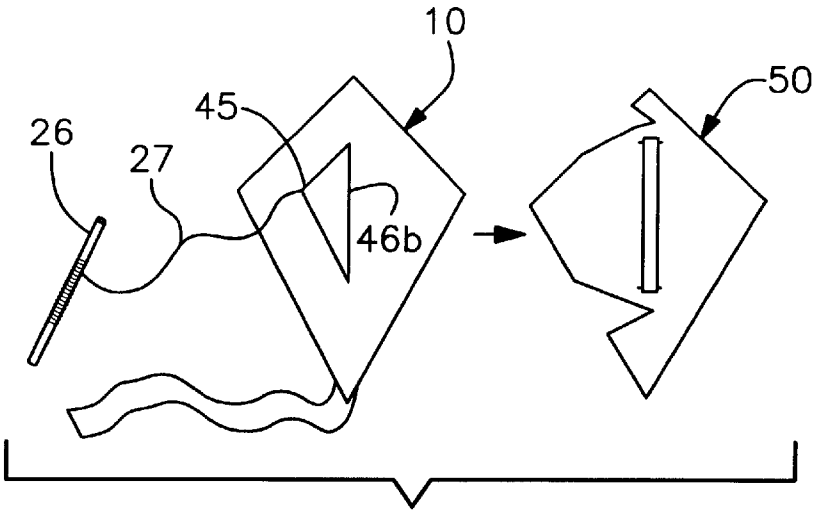
FIG. 14E depicts the step of removing the template from its overlying relation to the kite body.

After the adhesive has cured, template 50 is removed from kite body 10 in the three steps shown in FIGS. 14C, 14D, and 14E. As depicted in FIG. 14C, string 27 is removed from slots D and E. Next, as indicated in FIG. 14D, the opposite ends of loop 46 are separated from notches 57, 59 by displacing template 50 to the right as drawn. Further displacement in that direction of template 50 leaves kite body 10 fully exposed, as indicated in FIG. 14E, with opposite ends 46*c*, 46*d* of the bottom section 46*b* of loop 46 adhered to kite body 10 in the optimal position.

Miniature kite 10 is then prepared for packaging by coiling line 27 onto dowel pin 26, placing the dowel pin atop kite body 10, placing that assembly atop a pressboard 36, and coiling tail ribbons 16, 18 therearound in the same manner as the first embodiment.

Figure 15A:
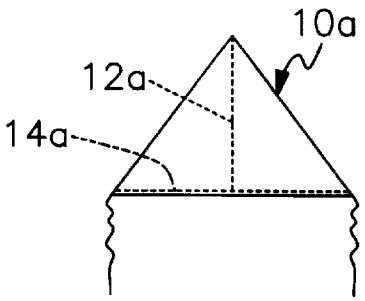
FIG. 15A depicts a kite body of triangular configuration.
Figure 15B:
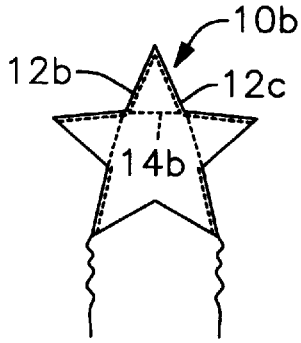
FIG. 15B depicts a kite body of five-pointed star configuration.
Figure 15C:
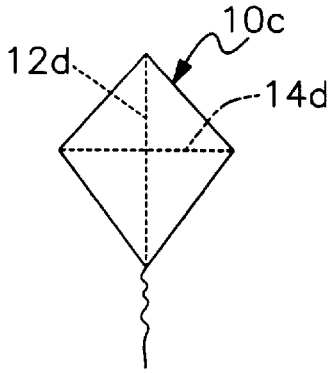
FIG. 15C depicts a kite body of substantially diamond-shaped configuration.
Figure 15D:
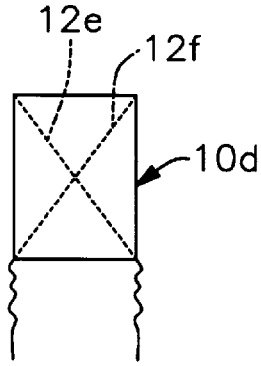
FIG. 15D depicts a kite body of rectangular configuration.
Figure 15E:
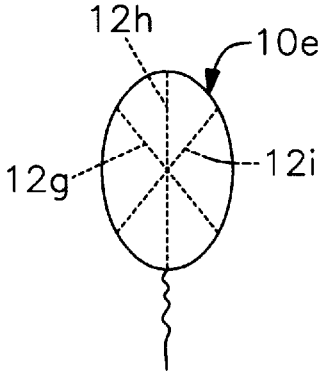
FIG. 15E depicts a kite body of substantially oval configuration.
Figure 15F:
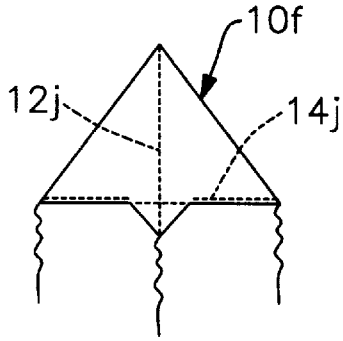
FIG. 15F depicts a kite body of substantially triangular configuration.
Figure 15G:
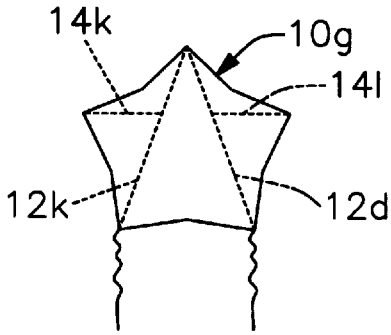
FIG. 15G depicts a kite body of substantially five-pointed star configuration.

The novel procedures disclosed above may be employed to make kites of widely varying shapes, and the coverage of this invention extends to kites of all shapes and sizes. For example, as depicted in FIG. 15A, kite body 10*a* may have a triangular shape and the, frame that maintains that shape may include a longitudinally disposed first stick 12*a* and a transversely disposed second stick 14*a*. As depicted in FIG. 15B, kite body 10*b* may have the configuration of a five-pointed star and in such event the frame for maintaining that shape would include sticks 12*b*, 12*c*, and 14*b*. FIG. 15C depicts kite body 10*c* of substantially diamond-shaped configuration, and its frame includes sticks 12*d* and 14*d*. Rectangular kite body 10*d* is depicted in FIG. 15D and its frame includes sticks 12*e* and 12*f* arranged in an "X" configuration. An oval kite body is denoted 10*e* in FIG. 15E and its frame preferably includes three sticks 12*g*, 12*h* and 12*i* arranged in the pattern of an asterisk. FIG. 15F depicts a substantially triangular kite body 10*f* having a frame formed by sticks 12*j* and 14*j*. Finally, a modified five-pointed star kite body 10*g* is depicted in FIG. 15G, and its frame is formed by sticks 12*k*, 12*l* and 14*k*, 14*l*. Numerous other shapes and appropriate frames therefore are within the scope of this invention, it being impractical to illustrate all other practical miniature kite designs made possible by this invention.

Note further that the embodiments of FIGS. 15A, 15B, 15D, and 15G are double-tailed, and the embodiment of FIG. 15F may be double or triple-tailed.

It will be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

Now that the invention has been described,

What is claimed is:

1. A method for making a kite; comprising the steps of:

forming a kite body of predetermined configuration;

securing a first elongate support member to a first side of said kite body;

securing at least a second elongate support member to said first side of said kite body;

securing an elongate tail means to a trailing end of a preselected side of said kite body;

coiling an elongate string about a dowel pin;

uncoiling a predetermined length of a first end of said string from said dowel pin;

mounting a pair of upstanding posts in laterally spaced apart relation to one another;

forming a taut loop around said posts by wrapping said uncoiled length of string around said posts and tying a knot therein to maintain said taut loop around said posts;

positioning said knot about midway between said posts;

providing a template having substantially the same shape and size as said kite body;

forming a closed end slot in said template coincident with a longitudinal axis of said template such that first and second ends of said closed end slot are spaced apart from leading and trailing ends of said kite body, respectively, by a predetermined distance;

forming a first notch in a first preselected side of said template near a leading end of said template, said first notch extending at its deepest point to a longitudinal axis of symmetry of said template and said deepest point being positioned between said first end of said closed end slot and a leading end of said template;

forming a second notch in said first preselected side of said template near a trailing end of said template, said second notch extending at its deepest point to a longitudinal axis of symmetry of said template and said deepest point being positioned between said second end of said closed end slot and a trailing end of said template;

removing said loop from said posts by inserting said first preselected side of said template through said loop, and positioning opposite ends of said loop in said first and second notches, respectively, said loop having a top section disposed on a first side of said template and a bottom section disposed on a second side of said template;

positioning said template atop said kite body in alignment therewith so that said bottom section of said loop is disposed in overlying relation to said kite body;

pulling a top section of said loop in a direction away from said slot formed in said template;

securing said bottom section of said loop to said kite body by applying an adhesive to said bottom section and said kite body at first and second points at opposite ends of said closed end slot, said first and second points being predetermined by the length of said closed end slot and by the registration of said template to said kite body; and removing said template from said overlying relation to said kite body.

2. The method of claim 1, further comprising the step of forming from said tissue paper a kite body of diamond-shaped configuration, securing said first elongate support member to said first side of said substantially diamond-shaped kite body in registration with a longitudinal axis of symmetry of said substantially diamond-shaped kite body, and securing a second elongate support member to said first side of said substantially diamond-shaped kite body in registration with a transverse axis of said substantially diamond-shaped kite body so that said first and second elongate support members are disposed at a substantially right angle to one another.

3. The method of claim 1, further comprising the step of forming from said tissue paper a kite body of substantially triangular configuration, securing said first elongate support member to said first side of said kite body in registration with a longitudinal axis of symmetry of said substantially triangular kite body, and securing a second elongate support member to said first side of said substantially triangular kite body in registration with a transverse axis of said substantially triangular kite body so that said first and second elongate support members are disposed at a substantially right angle to one another.

4. The method of claim 1, further comprising the step of forming from said tissue paper a kite body of substantially five-pointed star configuration, and securing first, second and third elongate support members to said first side of said kite body to form a frame that maintains said substantially five-pointed star configuration.

5. The method of claim 1, further comprising the step of forming from said tissue paper a kite body of rectangular configuration, and securing first and second elongate support members to said first side of said rectangular kite body in an "X" pattern to form a frame that maintains said rectangular configuration.

6. The method of claim 1, further comprising the step of forming from said tissue paper a kite body of substantially oval configuration, and securing first, second, and third elongate support members to said first side of said substantially oval kite body in an asterisk pattern to form a frame that maintains said substantially oval configuration.

* * * * *